US010638221B2

(12) United States Patent
King et al.

(10) Patent No.: US 10,638,221 B2
(45) Date of Patent: Apr. 28, 2020

(54) TIME INTERVAL SOUND ALIGNMENT

(71) Applicant: Adobe Inc., San Jose, CA (US)

(72) Inventors: Brian John King, Seattle, WA (US); Gautham J. Mysore, San Francisco, CA (US); Paris Smaragdis, Urbana, IL (US)

(73) Assignee: Adobe Inc., San Jose, CA (US)

( * ) Notice: Subject to any disclaimer, the term of this patent is extended or adjusted under 35 U.S.C. 154(b) by 113 days.

(21) Appl. No.: 13/675,844

(22) Filed: Nov. 13, 2012

(65) Prior Publication Data

US 2014/0133675 A1 May 15, 2014

(51) Int. Cl.
*H04R 3/00* (2006.01)

(52) U.S. Cl.
CPC ..... *H04R 3/005* (2013.01)

(58) Field of Classification Search
CPC . H04R 3/005; G06F 3/00; G06F 3/048; G06F 3/0481
USPC ..... 381/54, 61, 97, 102; 700/17, 83, 135; 715/716, 764, 835, 727
See application file for complete search history.

(56) References Cited

U.S. PATENT DOCUMENTS 4,550,425 A 10/1985 Andersen et al.
4,591,928 A 5/1986 Bloom et al.
5,055,939 A * 10/1991 Karamon ..... G03B 31/04 360/13
5,151,998 A 9/1992 Capps
5,301,109 A 4/1994 Landauer et al.
5,305,420 A 4/1994 Nakamura et al.
5,325,298 A 6/1994 Gallant
5,351,095 A 9/1994 Kerdranvat
5,418,717 A 5/1995 Su et al.
5,490,061 A 2/1996 Tolin et al.
5,510,981 A 4/1996 Berger et al.
5,642,522 A 6/1997 Zaenen et al.
5,652,828 A 7/1997 Silverman
5,671,283 A 9/1997 Michener et al.
5,710,562 A 1/1998 Gormish et al.
5,717,818 A 2/1998 Nejime et al.
5,729,008 A 3/1998 Blalock et al.
5,749,073 A * 5/1998 Slaney ..... G10H 7/008 704/203

(Continued)

FOREIGN PATENT DOCUMENTS

WO WO-2010086317 8/2010

OTHER PUBLICATIONS

Sonar, SONAR_X1, 2010, p. 573,595-599.*

(Continued)

*Primary Examiner* — William A Jerez Lora
(74) *Attorney, Agent, or Firm* — SBMC

(57) ABSTRACT

Time interval sound alignment techniques are described. In one or more implementations, one or more inputs are received via interaction with a user interface that indicate that a first time interval in a first representation of sound data generated from a first sound signal corresponds to a second time interval in a second representation of sound data generated from a second sound signal. A stretch value is calculated based on an amount of time represented in the first and second time intervals, respectively. Aligned sound data is generated from the sound data for the first and second time intervals based on the calculated stretch value.

20 Claims, 7 Drawing Sheets

(56) References Cited

U.S. PATENT DOCUMENTS 5,802,525 A 9/1998 Rigoutsos
5,842,204 A 11/1998 Andrews et al.
5,950,194 A 9/1999 Bennett et al.
6,122,375 A 9/2000 Takaragi et al.
6,266,412 B1 7/2001 Berenzweig et al.
6,304,846 B1 10/2001 George et al.
6,316,712 B1 11/2001 Laroche
6,333,983 B1 12/2001 Enichen
6,353,824 B1 3/2002 Boguraev et al.
6,370,247 B1 4/2002 Takaragi et al.
6,442,524 B1 8/2002 Ecker et al.
6,480,957 B1 11/2002 Liao et al.
6,687,671 B2 2/2004 Gudorf et al.
6,778,667 B1 8/2004 Bakhle et al.
6,792,113 B1 9/2004 Ansell et al.
6,804,355 B1 10/2004 Graunke
7,003,107 B2 2/2006 Ananth
7,103,181 B2 9/2006 Ananth
7,142,669 B2 11/2006 Dworkin et al.
7,155,440 B1 12/2006 Kronmiller et al.
7,200,226 B2 4/2007 Bace
7,213,156 B2 5/2007 Fukuda
7,218,733 B2 5/2007 Li et al.
7,221,756 B2 5/2007 Patel et al.
7,269,664 B2 9/2007 Hutsch et al.
7,269,854 B2 9/2007 Simmons et al.
7,350,070 B2 3/2008 Smathers et al.
7,412,060 B2 8/2008 Fukuda
7,418,100 B2 8/2008 McGrew et al.
7,533,338 B2 5/2009 Duncan et al.
7,536,016 B2 5/2009 Benaloh
7,594,176 B1 9/2009 English
7,603,563 B2 10/2009 Ansell et al.
7,627,479 B2 12/2009 Travieso et al.
7,636,691 B2 12/2009 Maari
7,672,840 B2 3/2010 Sasaki et al.
7,680,269 B2 3/2010 Nicolai et al.
7,693,278 B2 4/2010 Hiramatsu
7,711,180 B2 5/2010 Ito et al.
7,715,591 B2 5/2010 Owechko et al.
7,757,299 B2 7/2010 Robert et al.
7,827,408 B1 11/2010 Gehringer
7,836,311 B2 11/2010 Kuriya et al.
7,861,312 B2 12/2010 Lee et al.
7,884,854 B2 2/2011 Banner et al.
8,050,906 B1 11/2011 Zimmerman et al.
8,051,287 B2 11/2011 Shetty et al.
8,082,592 B2 12/2011 Harris
8,095,795 B2 1/2012 Levy
8,099,519 B2 1/2012 Ueda
8,103,505 B1 1/2012 Silverman et al.
8,130,952 B2 3/2012 Shamoon et al.
8,184,182 B2 5/2012 Lee et al.
8,189,769 B2 5/2012 Ramasamy et al.
8,199,216 B2 6/2012 Hwang
8,205,148 B1 * 6/2012 Sharpe et al. ..... 715/203
8,245,033 B1 8/2012 Shetty et al.
8,290,294 B2 10/2012 Kopf et al.
8,291,219 B2 10/2012 Eto
8,300,812 B2 10/2012 Van De Ven
8,315,396 B2 11/2012 Schreiner et al.
8,340,461 B2 12/2012 Sun et al.
8,345,976 B2 1/2013 Wang et al.
8,346,751 B1 1/2013 Jin et al.
8,417,806 B2 4/2013 Chawla et al.
8,428,390 B2 4/2013 Li et al.
8,520,083 B2 8/2013 Webster et al.
8,543,386 B2 9/2013 Oh et al.
8,571,308 B2 10/2013 Grafulla-González
8,583,443 B2 11/2013 Misawa
8,586,847 B2 11/2013 Ellis et al.
8,588,551 B2 11/2013 Joshi et al.
8,619,082 B1 12/2013 Ciurea et al.
8,675,962 B2 3/2014 Mori et al.
8,694,319 B2 4/2014 Bodin et al.
8,731,913 B2 5/2014 Zopf et al.
8,738,633 B1 5/2014 Sharifi et al.
8,751,022 B2 * 6/2014 Eppolito ..... G11B 27/034 700/94
8,805,560 B1 8/2014 Tzanetakis et al.
8,855,334 B1 10/2014 Lavine et al.
8,879,731 B2 11/2014 Schultz
8,886,543 B1 11/2014 Sharifi et al.
8,903,088 B2 12/2014 Schultz
8,914,290 B2 12/2014 Hendrickson et al.
8,953,811 B1 2/2015 Sharifi et al.
9,025,822 B2 5/2015 Jin et al.
9,031,345 B2 5/2015 Jin et al.
9,129,399 B2 9/2015 Jin et al.
9,165,373 B2 10/2015 Jin et al.
9,201,580 B2 * 12/2015 King ..... G06F 3/04847
9,355,649 B2 5/2016 King et al.
9,451,304 B2 9/2016 King et al.
10,249,321 B2 4/2019 King et al.
2002/0086269 A1 7/2002 Shpiro
2002/0097380 A1 * 7/2002 Moulton ..... G03B 31/00 352/5
2002/0099547 A1 7/2002 Chu et al.
2002/0154779 A1 10/2002 Asano et al.
2003/0028380 A1 2/2003 Freeland et al.
2004/0030656 A1 2/2004 Kambayashi et al.
2004/0122656 A1 6/2004 Abir
2004/0122662 A1 6/2004 Crockett
2004/0218834 A1 11/2004 Bishop et al.
2004/0254660 A1 12/2004 Seefeldt
2005/0015343 A1 1/2005 Nagai et al.
2005/0021323 A1 1/2005 Li
2005/0069207 A1 3/2005 Zakrzewski et al.
2005/0198448 A1 * 9/2005 Fevrier ..... G06F 9/544 711/154
2005/0201591 A1 9/2005 Kiselewich
2005/0232463 A1 10/2005 Hirvonen et al.
2006/0045211 A1 3/2006 Oh et al.
2006/0078194 A1 4/2006 Fradkin et al.
2006/0122839 A1 6/2006 Li-Chun Wang et al.
2006/0147087 A1 7/2006 Goncalves et al.
2006/0165240 A1 7/2006 Bloom et al.
2006/0173846 A1 8/2006 Omae et al.
2007/0061145 A1 3/2007 Edgington et al.
2007/0070226 A1 3/2007 Matusik et al.
2007/0087756 A1 4/2007 Hoffberg
2007/0242900 A1 10/2007 Chen et al.
2007/0273653 A1 11/2007 Chen et al.
2007/0286497 A1 12/2007 Podilchuk
2007/0291958 A1 12/2007 Jehan
2008/0120230 A1 5/2008 Lebegue et al.
2008/0278584 A1 11/2008 Shih et al.
2009/0055139 A1 2/2009 Agarwal et al.
2009/0110076 A1 4/2009 Chen
2009/0125726 A1 5/2009 Iyer et al.
2009/0259684 A1 10/2009 Knight et al.
2009/0276628 A1 11/2009 Cho et al.
2009/0279697 A1 11/2009 Schneider
2009/0290710 A1 11/2009 Tkachenko et al.
2009/0297059 A1 12/2009 Lee et al.
2009/0306972 A1 12/2009 Opitz et al.
2009/0307489 A1 12/2009 Endoh
2009/0315670 A1 12/2009 Naressi et al.
2010/0023864 A1 * 1/2010 Lengeling ..... G10H 1/0008 715/727
2010/0105454 A1 4/2010 Weber
2010/0128789 A1 5/2010 Sole et al.
2010/0153747 A1 6/2010 Asnaashari et al.
2010/0172567 A1 7/2010 Prokoski
2010/0208779 A1 8/2010 Park et al.
2010/0246816 A1 9/2010 Thomas et al.
2010/0257368 A1 10/2010 Yuen
2010/0272311 A1 10/2010 Nir et al.
2010/0279766 A1 11/2010 Pliska et al.
2010/0322042 A1 12/2010 Serletic et al.
2011/0026596 A1 2/2011 Hong
2011/0043603 A1 2/2011 Schechner et al.
2011/0112670 A1 5/2011 Disch et al.
2011/0131219 A1 6/2011 Martin-Cocher et al.

(56) References Cited

U.S. PATENT DOCUMENTS

| | | | | |
|---|---|---|---|---|
| 2011/0161669 | A1 | 6/2011 | Eto | |
| 2011/0170784 | A1 | 7/2011 | Tanaka et al. | |
| 2011/0173208 | A1 | 7/2011 | Vogel | |
| 2011/0230987 | A1 | 9/2011 | Anguera Miróet al. | |
| 2011/0261257 | A1* | 10/2011 | Terry et al. | 348/515 |
| 2012/0027295 | A1 | 2/2012 | Shao | |
| 2012/0042167 | A1 | 2/2012 | Marking et al. | |
| 2012/0046954 | A1 | 2/2012 | Lindahl et al. | |
| 2012/0105728 | A1 | 5/2012 | Liu | |
| 2012/0134574 | A1 | 5/2012 | Takahashi et al. | |
| 2012/0151320 | A1* | 6/2012 | McClements, IV | 715/230 |
| 2012/0173865 | A1 | 7/2012 | Swaminathan | |
| 2012/0173880 | A1 | 7/2012 | Swaminathan | |
| 2012/0216300 | A1 | 8/2012 | Vivolo et al. | |
| 2012/0321172 | A1 | 12/2012 | Jachalsky et al. | |
| 2013/0132733 | A1 | 5/2013 | Agrawal et al. | |
| 2013/0136364 | A1 | 5/2013 | Kobayashi | |
| 2013/0142330 | A1 | 6/2013 | Schultz | |
| 2013/0142331 | A1 | 6/2013 | Schultz | |
| 2013/0173273 | A1 | 7/2013 | Kuntz et al. | |
| 2013/0191491 | A1 | 7/2013 | Kotha et al. | |
| 2013/0230247 | A1 | 9/2013 | Schlosser et al. | |
| 2013/0235201 | A1 | 9/2013 | Kiyohara et al. | |
| 2013/0290818 | A1 | 10/2013 | Arrasvuori et al. | |
| 2014/0023291 | A1 | 1/2014 | Lin | |
| 2014/0119643 | A1 | 5/2014 | Price | |
| 2014/0135962 | A1 | 5/2014 | King et al. | |
| 2014/0136976 | A1 | 5/2014 | King et al. | |
| 2014/0140626 | A1 | 5/2014 | Cho | |
| 2014/0142947 | A1 | 5/2014 | King | |
| 2014/0148933 | A1 | 5/2014 | King | |
| 2014/0152776 | A1 | 6/2014 | Cohen | |
| 2014/0153816 | A1 | 6/2014 | Cohen | |
| 2014/0168215 | A1 | 6/2014 | Cohen | |
| 2014/0169660 | A1 | 6/2014 | Cohen | |
| 2014/0177903 | A1 | 6/2014 | Price | |
| 2014/0201630 | A1 | 7/2014 | Bryan | |
| 2014/0205141 | A1 | 7/2014 | Gao et al. | |
| 2014/0254881 | A1 | 9/2014 | Jin | |
| 2014/0254882 | A1 | 9/2014 | Jin | |
| 2014/0254933 | A1 | 9/2014 | Jin | |
| 2014/0254943 | A1 | 9/2014 | Jin | |
| 2014/0310006 | A1 | 10/2014 | Anguera Miro et al. | |

OTHER PUBLICATIONS

Sonar, Sonar_X1, 2010.*

VocAlign, VocALignPro, 2005.*

VocAlign, AudioSuite Plug-In for digidesign pro tools, 2005, p. 8 and p. 23.*

Sonar, Sonar X1 reference guide, 2010, p. 573.*

"Non-Final Office Action", U.S. Appl. No. 13/794,408, dated Sep. 10, 2014, 14 pages.

"Non-Final Office Action", U.S. Appl. No. 13/794,125, dated Oct. 24, 2014, 19 pages.

Zhang, et al., "Video Dehazing with Spatial and Temporal Coherence", The Visual Computer: International Journal of Computer Graphics—CGI'2011 Conference, vol. 27, Issue 6-8, Apr. 20, 2011, 9 pages.

Barnes, et al., "PatchMatch: A Randomized Correspondence Algorithm for Structural Image Editing", ACM SIGGRAPH 2009 Papers (New Orleans, Louisiana, Aug. 3-7, 2009), Aug. 3, 2009, 11 pages.

Barnes, et al., "The Generalized PatchMatch Correspondence Algorithm", European Conference on Computer Vision, Sep. 2010, Retrieved from <http://gfx.cs.princeton.edu/pubs/Barnes_2010_TGP/generalized_pm.pdf> on Sep. 9, 2010,Sep. 2010, 14 pages.

Brox, et al., "Large Displacement Optical Flow: Descriptor Matching in Variational Motion Estimation", IEEE Transactions on Pattern Analysis and Machine Intelligence, 2010, 2011, 14 pages.

Fattal, "Single Image Dehazing", presented at the ACM SIGGRAPH, Los Angeles, California, 2008., 2008, 9 pages.

He, et al., "Computing Nearest-Neighbor Fields via Propagation-Assisted KD-Trees", CVPR 2012, 2012, 8 pages.

He, et al., "Single Image Haze Removal Using Dark Channel Prior", In Computer Vision and Pattern Recognition, IEEE Conference on, 2009, 2009, 8 pages.

He, et al., "Statistics of Patch Offsets for Image Completion", ECCV 2012, 2012, 14 pages.

Korman, et al., "Coherency Sensitive Hashing", ICCV 2011, 2011, 8 pages.

Olonetsky, et al., "TreeCANN—k-d tree Coherence Approximate Nearest Neighbor algorithm", European Conference on Computer Vision, 2012, 2012, 14 pages.

"Sound Event Recognition With Probabilistic Distance SVMs", IEEE TASLP 19(6), 2011, 2011.

"Non-Final Office Action", U.S. Appl. No. 13/310,032, dated Jan. 3, 2013, 18 pages.

"Final Office Action", U.S. Appl. No. 13/310,032, dated Oct. 31, 2013, 21 pages.

"Time Domain Pitch Scaling using Synchronous Overlap and Add", retrieved from <http://homepages.inspire.net.nz/~jamckinnon/report/sola.htm> on Nov. 12, 2012, 3 pages.

"Non-Final Office Action", U.S. Appl. No. 13/309,982, dated Jan. 17, 2013, 32 pages.

"Final Office Action", U.S. Appl. No. 13/309,982, dated Nov. 1, 2013, 34 pages.

"Waveform Similarity Based Overlap-Add (WSOLA)", retrieved from <http://www.pjsip.org/pjmedia/docs/html/group_PJMED_WSOLA.htm> on Nov. 12, 2012, 4 pages.

De et al., "Traditional (?) Implementations of a Phase-Vocoder: The Tricks of the Trade", Proceedings of the COST G-6 Conference on Digital Audio Effects (DAFX-00), Verona, Italy, Dec. 7-9, 2000, retrieved from <http://128.112.136.35/courses/archive/spring09/cos325/Bernardini.pdf> on Nov. 12, 2012,Dec. 7, 2000, 7 pages.

Dolson, "The Phase Vocoder: A Tutorial", retrieved from <http://www.panix.com/~jens/pvoc-dolson.par> on Nov. 12, 2012, 11 pages.

Felzenszwalb, et al., "Efficient Belief Propagation for Early Vision", International Journal of Computer Vision, 70(1), 2006, pp. 41-54.

Gastal et al., "Shared Sampling for Real-Time Alpha Matting", Eurographics 2010, vol. 29, No. 2, 2010, 10 pages.

Gutierrez-Osuna, "L19: Prosodic Modificatin of Speech", Lecture based on [Taylor, 2009, ch. 14; Holmes, 2001, ch. 5; Moulines and Charpentier, 1990], retrieved from <http://research.cs.tamu.edu/prism/lectures/sp/l19.pdf> on Nov. 12, 2012, 35 pages.

He, et al., "Corner detector based on global and local curvature properties", Retrieved from <http://hub.hku.hk/bitstream/10722/57246/1/142282.pdf> on Dec. 21, 2012, May 2008, 13 pages.

He, et al., "A Global Sampling Method for Alpha Matting", CVPR 2011, 2011, pp. 2049-2056.

Hirsch, et al., "Fast Removal of Non-uniform Camera Shake", Retrieved from <http://webdav.is.mpg.de/pixel/fast_removal_of_camera_shake/files/Hirsch_ICCV2011_Fast%20removal%20of%20non-uniform%20camera%20shake.pdf> on Dec. 21, 2012, 8 pages.

Jia, "Single Image Motion Deblurring Using Transparency", Retrieved from <http://www.cse.cuhk.edu.hk/~leojia/all_final_papers/motion_deblur_cvpr07.pdf> on Dec. 21, 2012, 8 pages.

Klingbeil, "SPEAR: Sinusoidal Partial Editing Analysis and Resynthesis", retrieved from <http://www.klingbeil.com/spear/> on Nov. 12, 2012, 3 pages.

Kubo, et al., "Characterization of the Tikhonov Regularization for Numerical Analysis of Inverse Boundary Value Problems by Using the Singular Value Decomposition", Inverse Problems in Engineering Mechanics, 1998, 1998, pp. 337-344.

Levin, et al., "A Closed Form Solution to Natural Image Matting", CVPR, 2006, 2006, 8 pages.

Levin, et al., "Image and Depth from a Conventional Camera with a Coded Aperture", ACM Transactions on Graphics, SIGGRAPH 2007 Conference Proceedings, San Diego, CA, Retrieved from <http://groups.csail.mit.edu/graphics/CodedAperture/CodedAperture-LevinEtAl-SIGGRAPH07.pdf> on Dec. 21, 2012,2007, 9 pages.

Li, et al., "Instructional Video Content Analysis Using Audio Information", IEEE TASLP 14(6), 2006, 2006.

McAulay, et al., "Speech Processing Based on a Sinusoidal Model", The Lincoln Laboratory Journal, vol. 1, No. 2, 1998, retrieved from

(56) References Cited

OTHER PUBLICATIONS

<http://www.II.mit.edu/publications/journal/pdf/vol01_no2/1.2.3.speechprocessing.pdf> on Nov. 12, 2012,1988, pp. 153-168.
Moinet, et al., "PVSOLA: A Phase Vocoder with Synchronized Overlap-Add", Proc. of the 14th Int. Conference on Digital Audio Effects (DAFx-11), Paris, France, Sep. 19-23, 2011, retrieved from <http://tcts.fpms.ac.be/publications/papers/2011/dafx2011_pvsola_amtd.pdf> on Nov. 12, 2012,Sep. 19, 2011, 7 pages.
Park, et al., "Extracting Salient Keywords from Instructional Videos Using Joint Text, Audio and Visual Cues", Proceedings of the Human Language Technology Conference of the North American Chapter of the ACL, Association for Computational Linguistics, 2006,Jun. 2006, pp. 109-112.
Patton, "ELEC 484 Project—Pitch Synchronous Overlap-Add", retrieved from <http://www.joshpatton.org/yeshua/Elec484/Elec484_files/ELEC%20484%20-%20PSOLA%20Final%20Project%20Report.pdf> on Nov. 12, 2012, 11 pages.
Radhakrishnan, et al., "A Content-Adaptive Analysis and Representation Framework for Audio Event Discovery from "Unscripted" Multimedia", Hindawi Publishing Corporation, EURASIP Journal on Applied Signal Processing, vol. 2006, Article ID 89013, 2006, 24 pages.
Rodet, "Musical Sound Signal Analysis/Synthesis: Sinusoidal+Residual and Elementary Waveform Models", TFTS'97 (IEEE Time-Frequency and Time-Scale Workshop 97), Coventry, Grande Bretagne, août, 1997, retrieved from <http://articles.ircam.fr/textes/Rodet97e/index.html> on Nov. 12, 2012,1997, 16 pages.
Roelands, et al., "Waveform Similarity Based Overlap-Add (WSOLA) for Time-Scale Modification of Speech: Structures and Evaluation", retrieved from <http://citeseerx.ist.psu.edu/viewdoc/summary?doi=10.1.1.58.1356> on Nov. 12, 2012, 4 pages.
Serra, "A System for Sound Analysis/Transformation/Synthesis Based on a Deterministic Plus Stochastic Decomposition", retrieved from <https://ccrma.stanford.edu/files/papers/stanm58.pdf> on Nov. 12, 2012, Oct. 1989, 166 pages.
Serra, "Approaches to Sinusoidal Plus Residual Modeling", retrieved from <http://www.dtic.upf.edu/~xserra/cursos/CCRMA-workshop/lectures/7-SMS-related-research.pdf> on Nov. 12, 2012, 21 pages.
Serra, "Musical Sound Modeling with Sinusoids Plus Noise", published in C. Roads, S. Pope, A. Picialli, G. De Poli, editors. 1997. "Musical Signal Processing". Swets & Zeitlinger Publishers, retrieved from <http://web.media.mit.edu/~tristan/Classes/MAS.945/Papers/Technical/Serra_SMS_97.pdf> on Nov. 12, 2012,1997, 25 pages.
Smaragdis, "A Probabilistic Latent Variable Model for Acoustic Modeling", NIPS, 2006, 6 pages.
Smaragdis, "Supervised and Semi-Supervised Separation of Sounds from Single-Channel Mixtures", ICA'07 Proceedings of the 7th international conference on Independent component analysis and signal separation, 2007, 8 pages.
Smith, et al., "Blue Screen Matting", SIGGRAPH 96 Conference Proceedings, Aug. 1996, 10 pages.
Smith "MUS421/EE367B Applications Lecture 9C: Time Scale Modification (TSM) and Frequency Scaling/Shifting", retrieved from <https://ccrma.stanford.edu/~jos/TSM/TSM.pdf> on Nov. 12, 2012, Mar. 8, 2012, 15 pages.
Upperman, "Changing Pitch with PSOLA for Voice Conversion", retrieved from <http://cnx.org/content/m12474/latest/?collection=col10379/1.1> on Nov. 12, 2012, 1 page.
Verhelst, "Overlap-Add Methods for Time-Scaling of Speech", retrieved from <http://citeseerx.ist.psu.edu/viewdoc/summary?doi=10.1.1.128.7991> on Nov. 12, 2012, 25 pages.
Verhelst, et al., "An Overlap-Add Technique Based on Waveform Similarity (WSOLA) for High Quality Time-Scale Modification of Speech", retrieved from <http://citeseerx.ist.psu.edu/viewdoc/download?doi=10.1.1.202.5460&rep=rep1&type=pdf> on Nov. 12, 2012, 4 pages.
Yang, et al., "A Constant-Space Belief Propagation Algorithm for Stereo Matching", CVPR, 2010, 8 pages.
Yuan, et al., "Image Deblurring with Blurred/Noisy Image Pairs", Proceedings of ACM SIGGRAPH, vol. 26, Issue 3, Jul. 2007, 10 pages.
"Adobe Audion", User Guide, 2003, 390 pages.
"Corrected Notice of Allowance", U.S. Appl. No. 13/794,125, dated Apr. 9, 2015, 2 pages.
"Final Office Action", U.S. Appl. No. 13/690,755, dated Sep. 10, 2014, 7 pages.
"MPEG Surround Specification", International Organization for Standardization, Coding of Moving Pictures and Audio; ISO/IEF JTC 1/SC 29/WG 11; Bangkok, Thailand, Jan. 19, 2006, 186 pages.
"Non-Final Office Action", U.S. Appl. No. 13/309,982, dated Mar. 24, 2014, 35 pages.
"Non-Final Office Action", U.S. Appl. No. 13/310,032, dated Mar. 7, 2014, 21 pages.
"Non-Final Office Action", U.S. Appl. No. 13/660,159, dated Oct. 1, 2014, 7 pages.
"Non-Final Office Action", U.S. Appl. No. 13/675,711, dated Mar. 11, 2015, 14 pages.
"Non-Final Office Action", U.S. Appl. No. 13/675,807, dated Dec. 17, 2014, 18 pages.
"Non-Final Office Action", U.S. Appl. No. 13/680,952, dated Aug. 4, 2014, 8 pages.
"Non-Final Office Action", U.S. Appl. No. 13/681,643, dated Jan. 7, 2015, 10 pages.
"Non-Final Office Action", U.S. Appl. No. 13/688,421, dated Feb. 4, 2015, 18 pages.
"Non-Final Office Action", U.S. Appl. No. 13/690,755, dated Mar. 28, 2014, 7 pages.
"Non-Final Office Action", U.S. Appl. No. 13/794,219, dated Feb. 12, 2015, 28 pages.
"Non-Final Office Action", U.S. Appl. No. 13/794,300, dated Mar. 11, 2015, 18 pages.
"Notice of Allowance", U.S. Appl. No. 13/309,982, dated Jul. 30, 2014, 6 pages.
"Notice of Allowance", U.S. Appl. No. 13/310,032, dated Aug. 26, 2014, 6 pages.
"Notice of Allowance", U.S. Appl. No. 13/794,125, dated Jan. 30, 2015, 7 pages.
"Notice of Allowance", U.S. Appl. No. 13/794,408, dated Feb. 4, 2015, 7 pages.
"Restriction Requirement", U.S. Appl. No. 13/660,159, dated Jun. 12, 2014, 6 pages.
"Restriction Requirement", U.S. Appl. No. 13/722,825, dated Oct. 9, 2014, 7 pages.
"Supplemental Notice of Allowance", U.S. Appl. No. 13/310,032, dated Nov. 3, 2014, 4 pages.
Dong, et al., "Adaptive Object Detection and Visibility Improvement in Foggy Image", Journal of Multimedia, vol. 6, No. 1 (2011), Feb. 14, 2011, 8 pages.
Ioffe, "Improved Consistent Sampling, Weighted Minhash and L1 Sketching", ICDM '10 Proceedings of the 2010 IEEE International Conference on Data Mining, Dec. 2010, 10 pages.
Jehan, "Creating Music by Listening", In PhD Thesis of Massachusetts Institute of Technology, Retrieved from <http://web.media.mit.edu/~tristan/Papers/PhD_Tristan.pdf>,Sep. 2005, 137 pages.
Wu, "Fish Detection in Underwater Video of Benthic Habitats in Virgin Islands", University of Miami, May 29, 2012, 72 pages.
Zhu, et al., "Fusion of Time-of-Flight Depth and Stereo for High Accuracy Depth Maps", IEEE Conference on Computer Vision and Pattern Recognition, Jun. 23, 2008, 8 pages.
"Adobe Audition 3.0 User Guide", 2007, 194 pages.
"Final Office Action", U.S. Appl. No. 13/675,711, dated Jun. 23, 2015, 14 pages.
"Final Office Action", U.S. Appl. No. 13/675,807, dated May 22, 2015, 24 pages.
"Final Office Action", U.S. Appl. No. 13/681,643, dated May 5, 2015, 14 pages.
"Notice of Allowance", U.S. Appl. No. 13/794,219, dated Jun. 3, 2015, 9 pages.
"Notice of Allowance", U.S. Appl. No. 13/794,300, dated May 4, 2015, 8 pages.

(56) References Cited

OTHER PUBLICATIONS

"Supplemental Notice of Allowance", U.S. Appl. No. 13/794,408, dated Apr. 17, 2015, 2 pages.
"Corrected Notice of Allowance", U.S. Appl. No. 13/794,300, dated Jul. 30, 2015, 2 pages.
"Final Office Action", U.S. Appl. No. 13/688,421, dated Jul. 29, 2015, 22 pages.
"Notice of Allowance", U.S. Appl. No. 13/675,807, dated Aug. 27, 2015, 6 pages.
"Corrected Notice of Allowance", U.S. Appl. No. 13/794,219, dated Sep. 21, 2015, 2 pages.
"Non-Final Office Action", U.S. Appl. No. 13/681,643, dated Oct. 16, 2015, 27 pages.
"Notice of Allowance", U.S. Appl. No. 13/675,711, dated Jan. 20, 2016, 11 pages.
"Non-Final Office Action", U.S. Appl. No. 13/688,421, dated Jan. 7, 2016, 20 pages.
"Final Office Action", U.S. Appl. No. 13/661,643, dated Mar. 15, 2016, 25 pages.
"Notice of Allowance", U.S. Appl. No. 13/688,421, dated Jun. 6, 2016, 10 pages.
"Corrected Notice of Allowance", U.S. Appl. No. 13/688,421, dated Aug. 22, 2016, 2 pages.
"Non-Final Office Action", U.S. Appl. No. 13/681,643, dated Nov. 17, 2016, 23 pages.
"Non-Final Office Action", U.S. Appl. No. 13/681,643, dated Oct. 20, 2017, 34 pages.
"Supplemental Notice of Allowance", U.S. Appl. No. 13/681,643, dated Dec. 6, 2018, 10 pages.
"Notice of Allowance", U.S. Appl. No. 13/681,643, dated Nov. 13, 2018, 12 pages.
"Final Office Action", U.S. Appl. No. 13/681,643, dated Apr. 12, 2017, 40 pages.
"Final Office Action", U.S. Appl. No. 13/681,643, dated May 4, 2018, 24 pages.
"Advisory Action", U.S. Appl. No. 13/681,643, dated Jul. 24, 2018, 3 pages.
"Supplemental Notice of Allowance", U.S. Appl. No. 13/681,643, dated Mar. 1, 2019, 10 pages.

* cited by examiner

TIME INTERVAL SOUND ALIGNMENT

BACKGROUND

Sound alignment may be leveraged to support a wide range of functionality. For example, sound data may be captured for use as part of a movie, recording of a song, and so on. Parts of the sound data, however, may reflect capture in a noisy environment and therefore may be less than desirable when output, such as by being difficult to understand, interfere with desired sounds, and so on. Accordingly, parts of the sound data may be replaced by other sound data using sound alignment. Sound alignment may also be employed to support other functionality, such as to utilize a foreign overdub to replace the sound data with dialogue in a different language.

However, conventional techniques that are employed to automatically align the sound data may prove inadequate when confronted with disparate types of sound data, such as to employ a foreign overdub. Accordingly, these conventional techniques may cause a user to forgo use of these techniques as the results were often inconsistent, could result in undesirable alignments that lacked realism, and so forth. This may force users to undertake multiple re-recordings of the sound data that is to be used as a replacement until a desired match is obtained, manual fixing of the timing by a sound engineer, and so on.

SUMMARY

Time interval sound alignment techniques are described. In one or more implementations, one or more inputs are received via interaction with a user interface that indicates that a first time interval in a first representation of sound data generated from a first sound signal corresponds to a second time interval in a second representation of sound data generated from a second sound signal. A stretch value is calculated based on an amount of time represented in the first and second time intervals, respectively. Aligned sound data is generated from the sound data for the first and second time intervals based on the calculated stretch value.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Sound alignment techniques may be employed to support a variety of different functionality. For example, sound data having a higher quality may be synchronized with sound data having a lower quality to replace the lower quality sound data, such as to remove noise from a video shoot, music recording, and so on. In another example, a foreign overdub may be used to replace original sound data for a movie with dialogue in a different language. However, conventional auto-alignment systems could result in an output having incorrect alignment, could consume significant amounts of computing resources, and so on, especially when confronted with sound data having significantly different spectral characteristics, such as for a foreign overdub, to remove foul language, and so on.

Time interval sound alignment techniques are described herein. In one or more implementations, a user interface is configured to enable a user to specify particular time intervals of sound data that are to be aligned to each other. A stretch value is then calculated that defines a difference in the amount of time referenced by the respective time intervals. The stretch value is then used to stretch or compress the sound data for the corresponding time intervals to generate aligned sound data. In this way, these techniques may operate to align sound data that may have different spectral characteristics as well as promote an efficient use of computing resources. Further discussion of these and other examples may be found in relation to the following sections.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
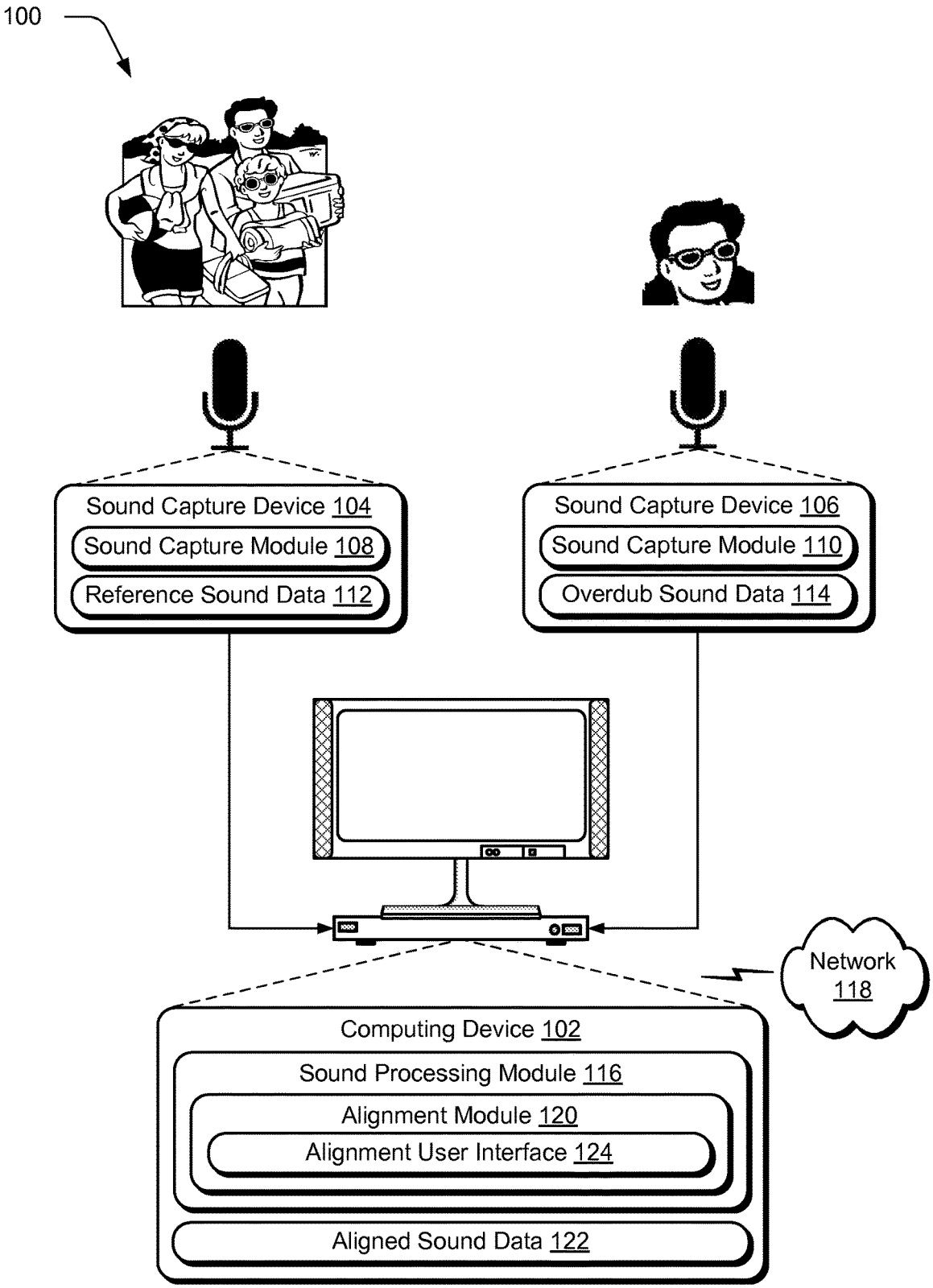
FIG. 1 is an illustration of an environment in an example implementation that is operable to employ time interval alignment techniques as described herein.

FIG. 1 is an illustration of an environment 100 in an example implementation that is operable to employ item interval sound alignment techniques described herein. The illustrated environment 100 includes a computing device 102 and sound capture devices 104, 106, which may be configured in a variety of ways.

The computing device 102, for instance, may be configured as a desktop computer, a laptop computer, a mobile device (e.g., assuming a handheld configuration such as a tablet or mobile phone), and so forth. Thus, the computing device 102 may range from full resource devices with substantial memory and processor resources (e.g., personal computers, game consoles) to a low-resource device with limited memory and/or processing resources (e.g., mobile devices). Additionally, although a single computing device 102 is shown, the computing device 102 may be representative of a plurality of different devices, such as multiple servers utilized by a business to perform operations "over the cloud" as further described in relation to FIG. 7.

The sound capture devices 104, 106 may also be configured in a variety of ways. Illustrated examples of one such configuration involves a standalone device but other configurations are also contemplated, such as part of a mobile phone, video camera, tablet computer, part of a desktop microphone, array microphone, and so on. Additionally, although the sound capture devices 104, 106 are illustrated separately from the computing device 102, the sound capture devices 104, 106 may be configured as part of the computing device 102, a single sound capture device may be utilized in each instance, and so on.

The sound capture devices 104, 106 are each illustrated as including respective sound capture modules 108, 110 that are representative of functionality to generate sound data, examples of which include reference sound data 112 and overdub sound data 114. Reference sound data 112 is utilized to describe sound data for which at least a part is to be replaced by the overdub sound data 114. This may include replacement of noisy portions (e.g., due to capture of the reference sound data 112 "outside"), use of a foreign overdub, and replacement using sound data that has different spectral characteristics. Thus, the overdub sound data 114 may be thought of as unaligned sound data that is to be processed for alignment with the reference sound data 112. Additionally, although illustrated separately for clarity in the discussion, it should be apparent that these roles may be satisfied alternately by different collections of sound data (e.g., in which different parts are taken from two or more files), and so on.

Regardless of where the reference sound data 112, and overdub sound data 114 originated, this data may then be obtained by the computing device 102 for processing by a sound processing module 116. Although illustrated as part of the computing device 102, functionality represented by the sound processing module 116 may be further divided, such as to be performed "over the cloud" via a network 118 connection, further discussion of which may be found in relation to FIG. 7.

An example of functionality of the sound processing module 116 is represented as an alignment module 120. The alignment module 120 is representative of functionality to align the overdub sound data 114 to the reference sound data 112 to create aligned sound data 122. As previously described, this may be used to replace a noisy portion of sound data, replace dialogue with other dialogue (e.g., for different languages), and so forth. In order to aid in the alignment, the alignment module 120 may support an alignment user interface 124 via which user inputs may be received to indicate corresponding time intervals of the reference sound data 112 to the overdub sound data 114. Further discussion of generation of the aligned sound data 122 and interaction with the alignment user interface 124 may be found in the following discussion and associated figure.

Figure 2:
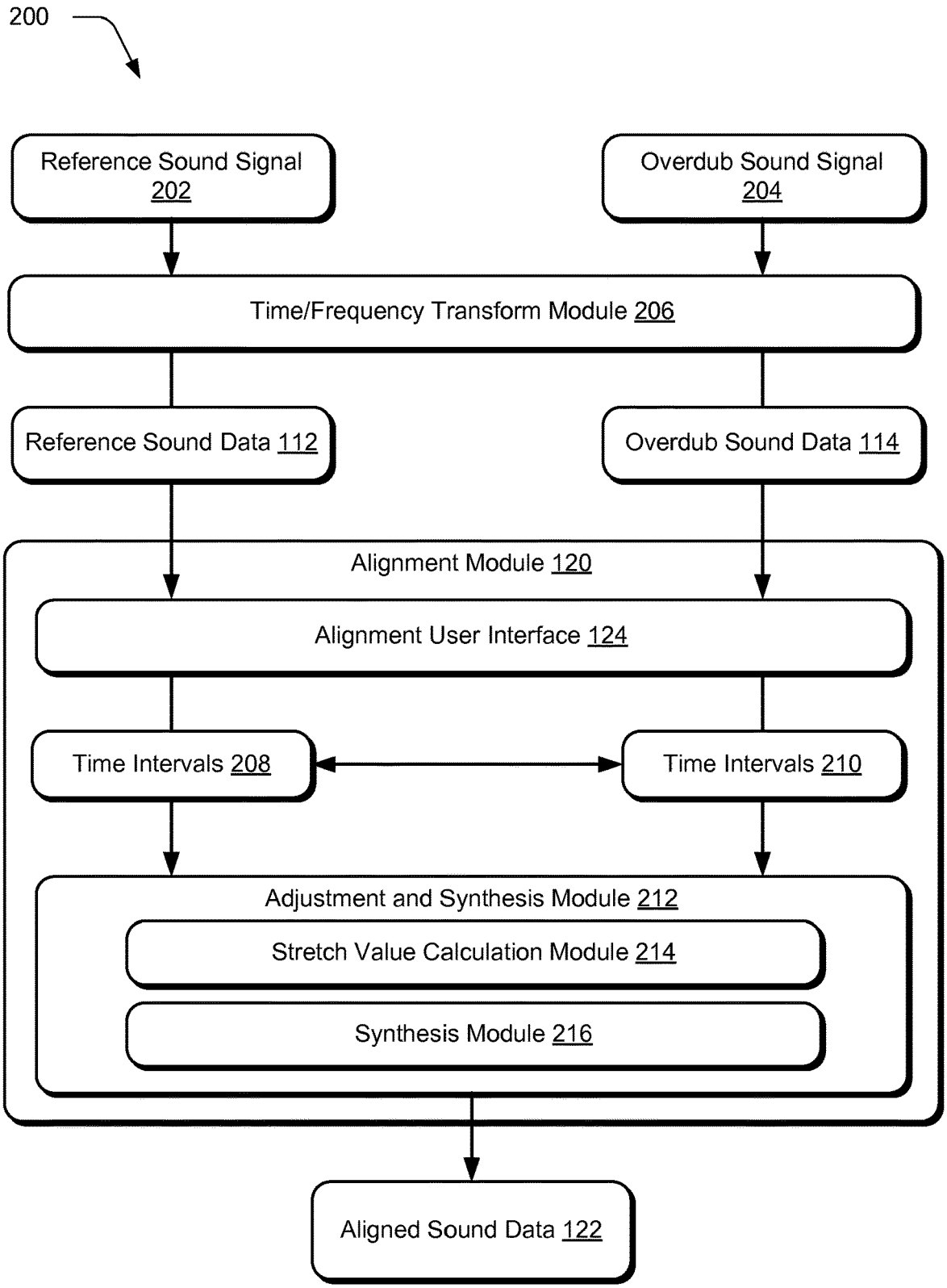
FIG. 2 depicts a system in an example implementation in which aligned sound data is generated from overdub sound data and reference sound data of FIG. 1 using time intervals.

FIG. 2 depicts a system 200 in an example implementation in which aligned sound data 122 is generated from overdub sound data 114 and reference sound data 112 from FIG. 1. A reference sound signal 202 and an overdub sound signal 204 are processed by a time/frequency transform module 206 to create reference sound data 112 and overdub sound data 114, which may be configured in a variety of ways.

The sound data, for instance, may be used to form one or more spectrograms of a respective signal. For example, a time-domain signal may be received and processed to produce a time-frequency representation, e.g., a spectrogram, which may be output in an alignment user interface 124 for viewing by a user. Other representations are also contemplated, such as a time domain representation, an original time domain signal, and so on. Thus, the reference sound data 112 and overdub sound data 114 may be used to provide a time-frequency representation of the reference sound signal 202 and overdub sound signal 204, respectively, in this example. Thus, the reference and overdub sound data 112, 114 may represent sound captured by the devices.

Spectrograms may be generated in a variety of ways, an example of which includes calculation as magnitudes of short time Fourier transforms (STFT) of the signals. Additionally, the spectrograms may assume a variety of configurations, such as narrowband spectrograms (e.g., 32 ms windows) although other instances are also contemplated. The STFT sub-bands may be combined in a way so as to approximate logarithmically-spaced or other nonlinearly-spaced sub-bands.

Overdub sound data 114 and reference sound data 112 are illustrated as being received for output by an alignment user interface 124. The alignment user interface 124 is configured to output representations of sound data, such as a time or time/frequency representation of the reference and overdub sound data 112, 114. In this way, a user may view characteristics of the sound data and identify different portions that may be desirable to align, such as to align sentences, phrases, and so on. A user may then interact with the alignment user interface 124 to define time intervals 208, 210 in the reference sound data 112 and the overdub sound data 114 that are to correspond to each other.

The time intervals 208, 210 may then be provided to an adjustment and synthesis module 212 to generate aligned sound data 122 from the reference and overdub sound data 114. For example, a stretch value calculation module 214 may be employed to calculate a stretch value that describes a difference between amounts of time described by the respective time intervals 208, 210. The time interval 208 of the reference sound data 112, for instance, may be 120% longer than the time interval 210 for the overdub sound data 114. Accordingly, the sound data that corresponds to the item interval 210 for the overdub sound data 114 may be stretched by this stretch value by the synthesis module 216 to form the aligned sound data 122.

Results from conventional temporal alignment techniques when applied to sound data having dissimilar spectral characteristics such as foreign overdubs could include inconsistent timing and artifacts. However, the time interval techniques described herein may be used to preserve relative timing in the overdub sound data 114, and thus avoid the inconsistent timing and artifacts of conventional frame-by-frame alignment techniques that were feature based.

For example, if the reference and overdub sound data 112, 114 include significantly different features, alignment of those features could result in inaccuracies. Such features may be computed in a variety of ways. Examples of which include use of an algorithm, such as Probabilistic Latent Component Analysis (PLCA), non-negative matrix factorization (NMF), non-negative hidden Markov (N-HMM), non-negative factorial hidden Markov (N-FHMM), and the like. The time intervals, however, may be used to indicate correspondence between phrases, sentences, and so on even if having dissimilar features and may preserve relative timing of those intervals.

Further, processing performed using the time intervals may be performed using fewer computational resources and thus may be performed with improved efficiency. For example, the longer the clip, the more likely it was to result in an incorrect alignment using conventional techniques. Second, computation time is proportionate to the length of clips, such as the length of the overdub clip times the length of the reference clip. Therefore, if the two clip lengths double, the computation time quadruples. Consequently, conventional processing could be resource intensive, which could result in delays to even achieve an undesirable result.

However, efficiency of the alignment module 120 may also be improved through use of the alignment user interface 124. Through specification of the alignment points, for instance, an alignment task for the two clips in the previous example may be divided into a plurality of interval alignment tasks. Results of the plurality of interval alignment tasks may then be combined to create aligned sound data 122 for the two clips. For example, adding "N" pairs of alignment points may increase computation speed by a factor between "N" and "$N^2$". An example of the alignment user interface 124 is discussed as follows and shown in a corresponding figure.

Figure 3:
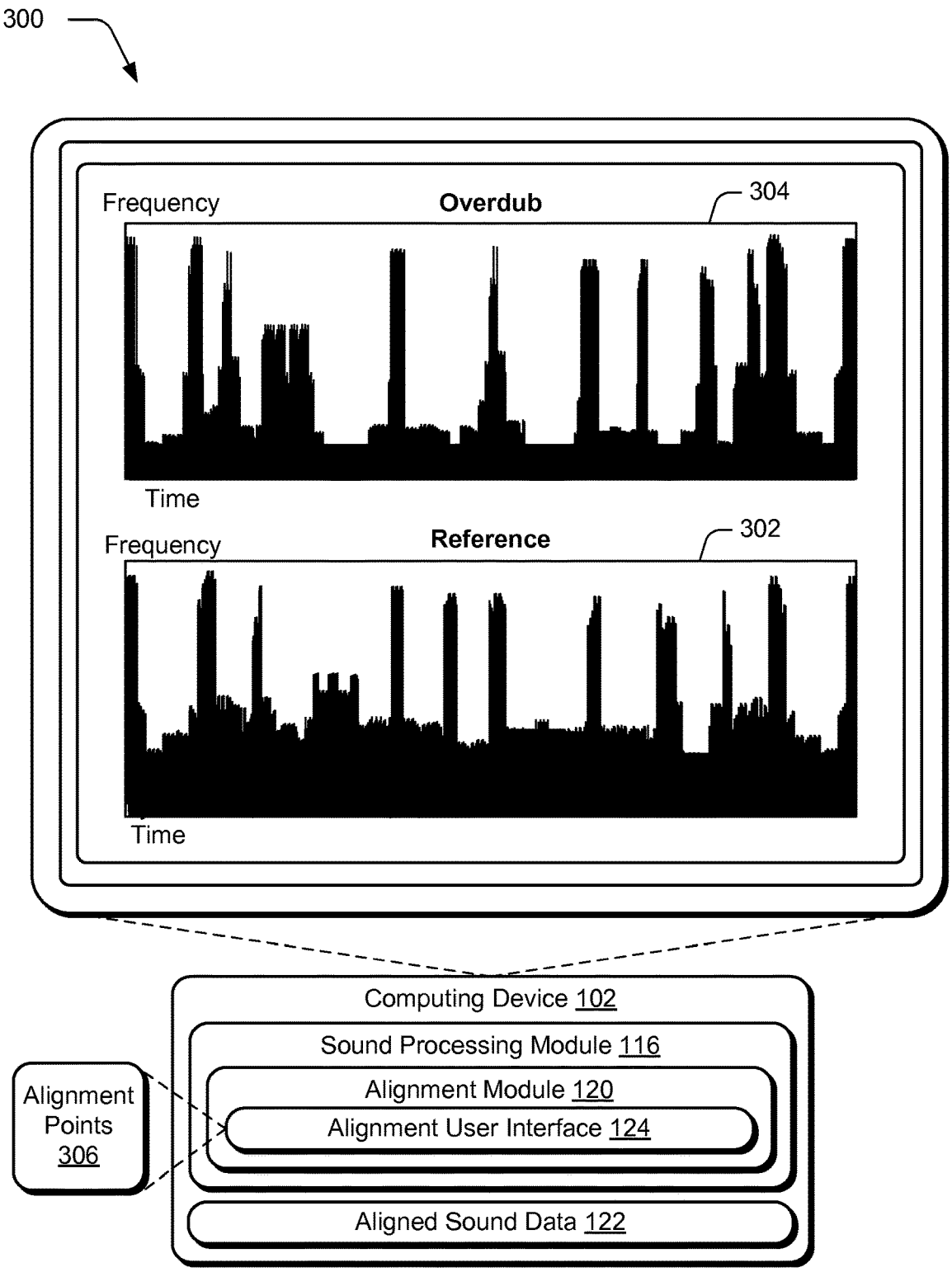
FIG. 3 depicts a system in an example implementation in which an example alignment user interface is shown that includes representations of the overdub and reference sound data.

FIG. 3 depicts an example implementation 300 showing the computing device 102 of FIG. 1 as outputting an alignment user interface 124 for display. In this example, the computing device 102 is illustrated as assuming a mobile form factor (e.g., a tablet computer) although other implementations are also contemplated as previously described. In the illustrated example, the reference sound data 112 and the overdub sound data 114 are displayed in the alignment user interface 124 using respective time-frequency representations 302, 304, e.g., spectrograms, although other examples are also contemplated.

The representations 302, 304 are displayed concurrently in the alignment user interface 124 by a display device of the computing device 102, although other examples are also contemplated, such as through sequential output for display. The alignment user interface 124 is configured such that alignment points 306 may be specified to indicate correspondence of points in time between the representations 302, 304, and accordingly correspondence of sound data represented at those points in time. The alignment module 120 may then generated aligned sound data 122 as previously described based on the alignment points 306. The alignment points 306 may be specified in a variety of ways, an example of which is discussed as follows and shown in the corresponding figure.

Figure 4:
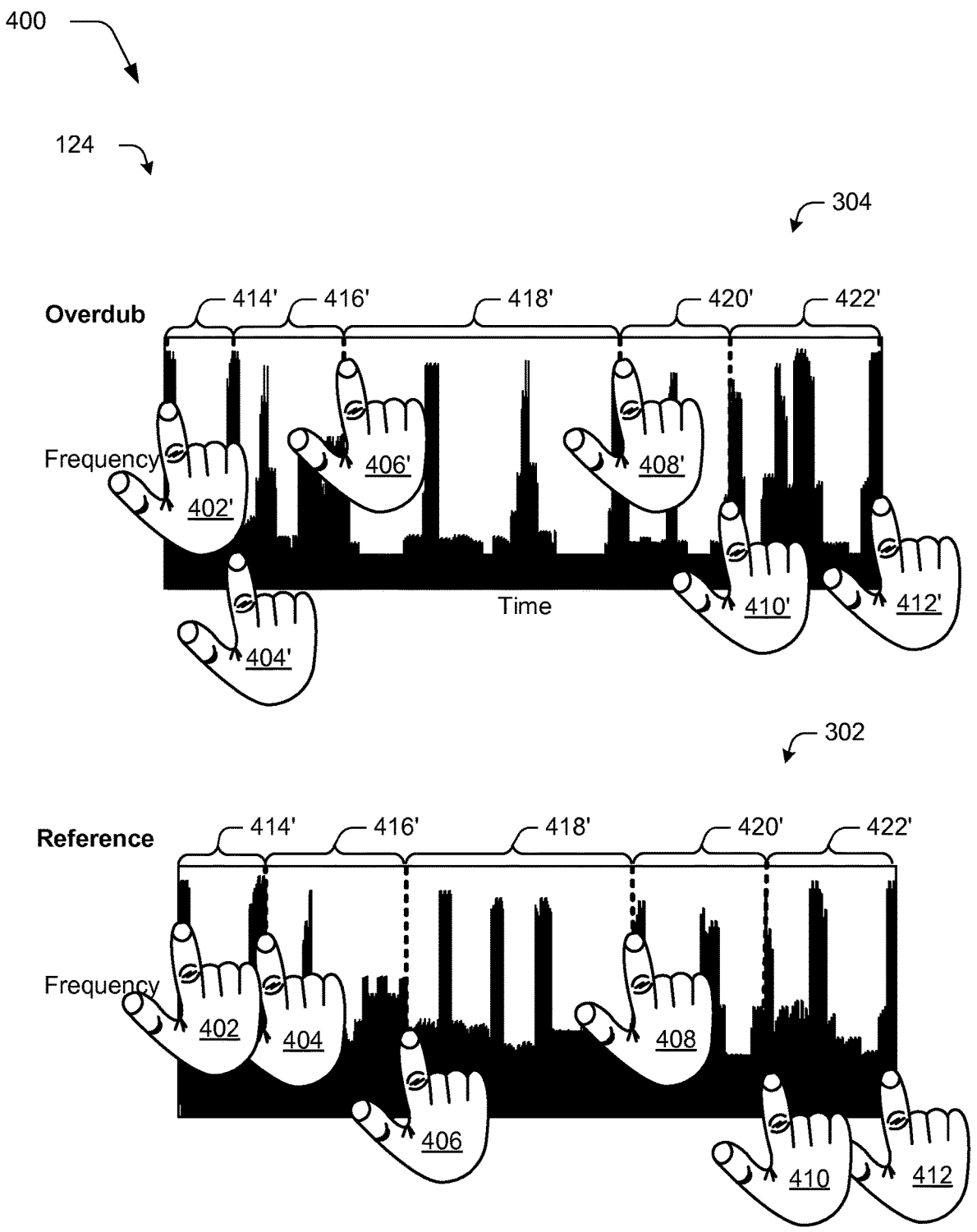
FIG. 4 depicts a system in an example implementation in which the example alignment user interface of FIG. 3 is shown as supporting interaction to manually specify time intervals.

FIG. 4 depicts an example implementation 400 in which the representations of the reference and overdub sound data 302, 304 are utilized to indicate corresponding points in time. In this implementation 400, a series of inputs are depicted as be provided via a touch input, although other examples are also contemplated, such as use of a cursor control device, keyboard, voice command, and so on. Correspondence of the alignment points and time intervals is illustrated through use of a convention in which alignment point 402 of the representation 302 of the reference sound signal 112 corresponds to alignment point 402' of the representation 304 of the overdub sound signal 114 and vice versa.

A user, when viewing the representations 302, 304 of the reference and overdub sound signals 112, 114 may notice particular points it time that are to be aligned based on spectral characteristics as displayed in the alignment user interface 124, even if those spectral characteristics pertain to different sounds. For example, a user may note that spectral characteristics in the representations 302, 304 each pertain to the beginning of a phrase at alignment points 402, 402'. Accordingly, the user may indicate such through interaction with the alignment user interface by setting the alignment points 402, 402'. The user may repeat this by selecting additional alignment points 404, 404', 406, 406', 408, 408', 410, 410', which therefore also define a plurality of time intervals 414, 414', 416, 416', 418, 418', 420, 420', 422, 422' as corresponding to each other.

This selection, including the order thereof, may be performed in a variety of ways. For example, a user may select an alignment point 402 in the representation 302 of the reference sound data 112 and then indicate a corresponding point in time 402' in the representation 304 of the overdub sound signal 114. This selection may also be reversed, such as by selecting an alignment point 402' in the representation 304 of the overdub sound data 114 and then an alignment point 402 in the representation 302 of the reference sound data 112. Thus, in both of these examples a user alternates selections between the representations 302, 304 to indicate corresponding points in time.

Other examples are also contemplated. For example, the alignment user interface 124 may also be configured to support a series of selections made through interacting with one representation (e.g., alignment point 402, 404 in representation 302) followed by a corresponding series of selections made through interacting with another representation, e.g., alignment points 402', 404' in representation 302. In another example, alignment points may be specified having unique display characteristics to indicate correspondence, may be performed through a drag-and-drop operations, and so on. Further, other examples are also contemplated, such as to specify the time intervals 414, 414' themselves as corresponding to each other, for which a variety of different user interface techniques may be employed.

Regardless of a technique used to indicate the alignment points for the time intervals, a result of this manual alignment through interaction with the alignment user interface 124 indicates correspondence between the sound data. This correspondence may be leveraged to generate the aligned sound data 122. An example of the alignment user interface 124 showing a representation of the aligned sound data 122 is discussed as follows and shown in the corresponding figure.

Figure 5:
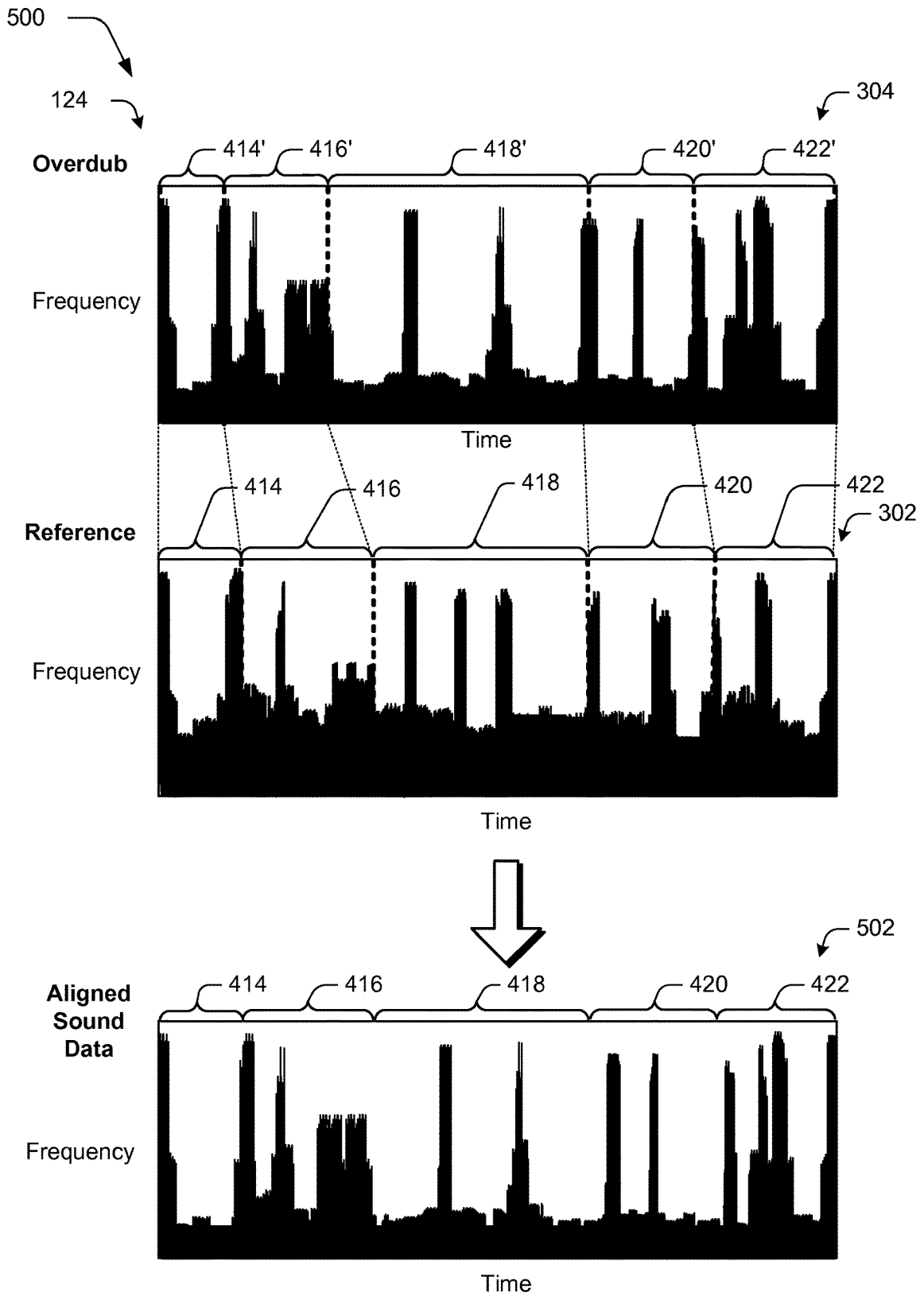
FIG. 5 depicts a system in an example implementation in which the example alignment user interface is shown as including a result of aligned sound data generated based at least in part on the specified time intervals in FIG. 4.

FIG. 5 depicts an example implementation 500 of the alignment user interface 124 as including a representation 502 of aligned sound data 122. As shown in the representations 302, 304 of the reference sound data 112 and the overdub sound data, time intervals 414-422 in the representation 302 of the reference sound data 112 have lengths (i.e., describe amounts of time) that are different than the time intervals 414'-422' in the representation 304 of the overdub sound data 114. For example, interval 414 references an amount of time that is greater than interval 414', interval 418 references an amount of time that is less than interval 418', and so on. It should be readily apparent, however, that in some instances the lengths of the intervals may also match.

The alignment module 120 may use this information in a variety of ways to form aligned sound data 122. For example, the alignment points may be utilized to strictly align those points in time specified by the alignment points 306 for the reference and overdub sound data 112, 114 as corresponding to each other at a beginning and end of the time intervals. The alignment module 120 may then utilize a stretch value that is computed based on the difference in the length to align sound data within the time intervals as a whole and thereby preserve relative timing within the time intervals. This may include stretching and/or compressing sound data included within the time intervals as a whole using the stretch values to arrive at aligned sound data for that interval.

Additionally, processing of the sound data by interval may be utilized to improve efficiency as previously described. The alignment module 120, for instance, may divide the alignment task for the reference sound data 112 and the overdub sound data 114 according to the specified time intervals. For example, the alignment task may be divided into "N+1" interval alignment tasks in which "N" is a number of user-defined alignment points 306. Two or more of the interval alignment tasks may also be run in parallel to further speed-up performance. Once alignment is finished for the intervals, the results may be combined to arrive at the aligned sound data 122 for the reference sound data 112 and the overdub sound data 114. In one or more implementations, a representation 502 of this result of the aligned sound data 114 may also be displayed in the alignment user interface 124.

As shown in FIG. 5, for instance, the representation 302 of the reference sound data 114 may have different spectral characteristics than the representation 304 of the overdub sound data 114. This may be due to a variety of different reasons, such as a foreign overdub, to replace strong language, and so on. However, through viewing the representations 302, 304 a user may make note of a likely beginning and end of phrases, sentences, utterances, and so on. Accordingly, a user may interact with the alignment user interface 124 to indicate correspondence of the timing intervals. Stretch values may then be computed for the corresponding time intervals and used to adjust the time intervals in the overdub sound data 114 to the time intervals of the reference sound data 112. In this way, the aligned sound data 122 may be generated that includes the overdub sound data 114 as aligned to the time intervals of the reference sound data 112.

Example Procedures

The following discussion describes user interface techniques that may be implemented utilizing the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to FIGS. 1-5.

Figure 6:
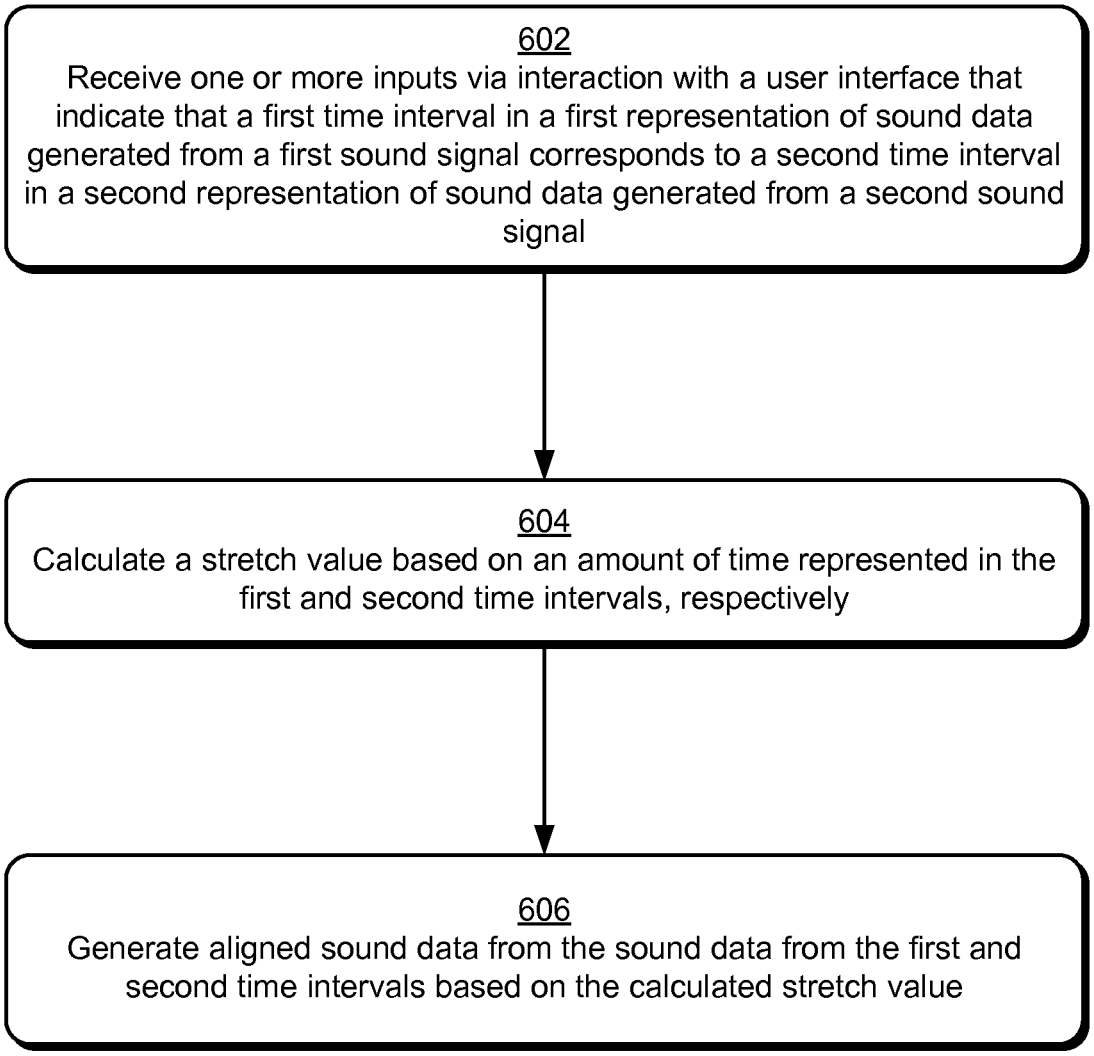
FIG. 6 is a flow diagram depicting a procedure in an example implementation in which a user interface is output that is configured to receive inputs that specify corresponding time intervals in representations of sound data that are to be aligned.

FIG. 6 depicts a procedure 600 in an example implementation in which a user interface in output that is usable to manually align particular time intervals to each other in sound data. One or more inputs are received via interaction with a user interface that indicate that a first time interval in a first representation of sound data generated from a first sound signal corresponds to a second time interval in a second representation of sound data generated from a second sound signal (block 602). As shown in FIG. 4, for instance, a user may set alignment points in a variety of different ways to define time intervals in respective representations 302, 304 that are to correspond to each other.

A stretch value is calculated based on an amount of time represented in the first and second time intervals, respectively (block 604). For example, the time intervals may describe different amounts of time. Accordingly, the stretch value may be calculated to describe an amount of time a time interval is to be stretched or compressed as a whole to match an amount of time described by another time interval. For example, the stretch value may be used to align a time interval in the overdub sound data 114 to a time interval in the reference sound data 112.

Aligned sound data is generated from the sound data for the first and second time intervals based on the calculated stretch value (block 606). The generation may be performed without computation of features and alignment thereof as in conventional techniques, thereby preserving relative timing of the intervals. However, implementations are also contemplated in which features are also leveraged, which may be used to stretch and compress portions with the time intervals, the use of which may be constrained by a cost value to still promote preservation of the relative timing, generally.

Example System and Device

Figure 7:
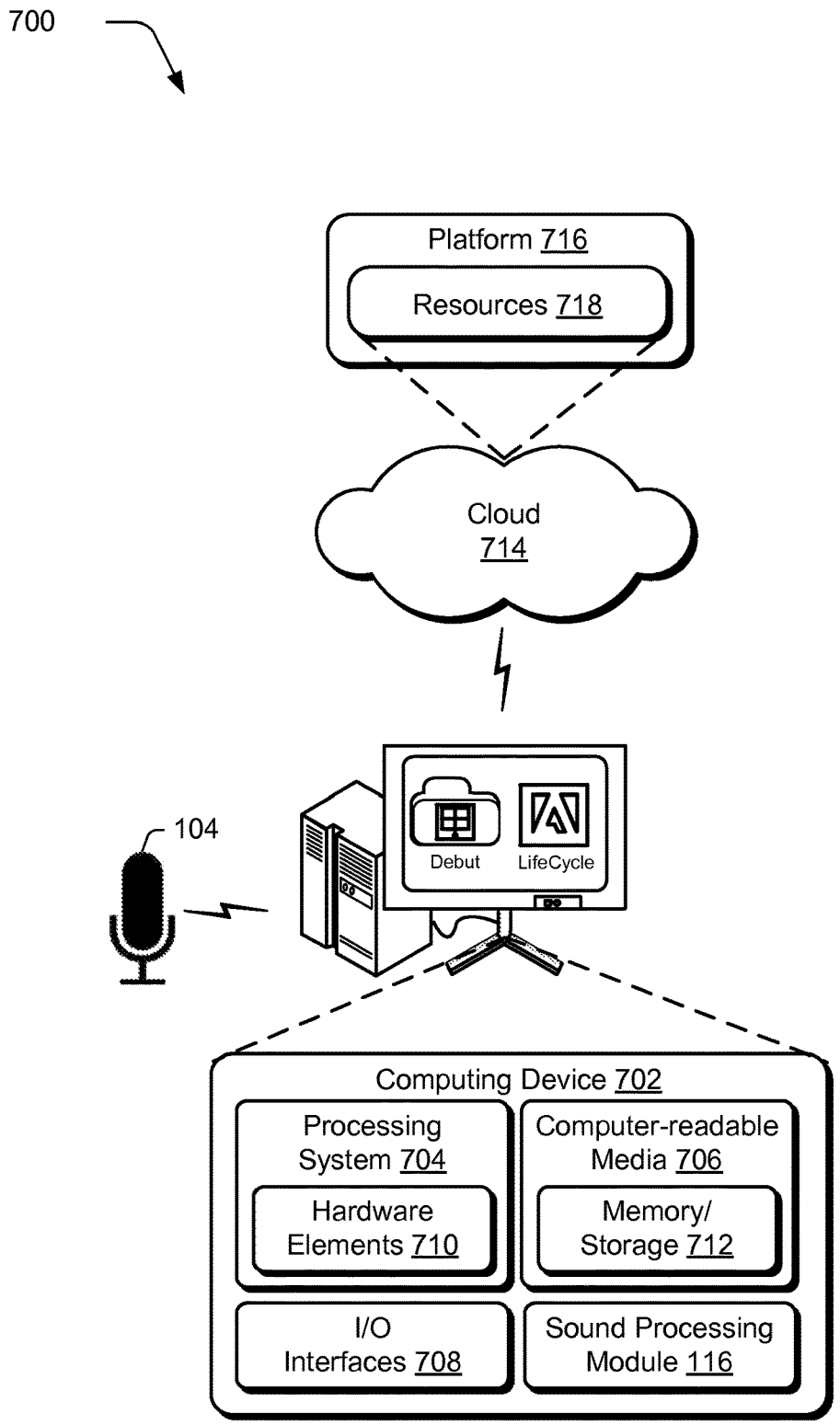
FIG. 7 illustrates an example system including various components of an example device that can be implemented as any type of computing device as described and/or utilize with reference to FIGS. 1-6 to implement embodiments of the techniques described herein.

FIG. 7 illustrates an example system generally at 700 that includes an example computing device 702 that is representative of one or more computing systems and/or devices that may implement the various techniques described herein. This is illustrated through inclusion of the sound processing module 116, which may be configured to process sound data, such as sound data captured by an sound capture device 104. The computing device 702 may be, for example, a server of a service provider, a device associated with a client (e.g., a client device), an on-chip system, and/or any other suitable computing device or computing system.

The example computing device 702 as illustrated includes a processing system 704, one or more computer-readable media 706, and one or more I/O interface 708 that are communicatively coupled, one to another. Although not shown, the computing device 702 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 704 is representative of functionality to perform one or more operations using hardware. Accordingly, the processing system 704 is illustrated as including hardware element 710 that may be configured as processors, functional blocks, and so forth. This may include implementation in hardware as an application specific integrated circuit or other logic device formed using one or more semiconductors. The hardware elements 710 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 706 is illustrated as including memory/storage 712. The memory/storage 712 represents memory/storage capacity associated with one or more computer-readable media. The memory/storage component 712 may include volatile media (such as random access memory (RAM)) and/or nonvolatile media (such as read only memory (ROM), Flash memory, optical disks, magnetic disks, and so forth). The memory/storage component 712 may include fixed media (e.g., RAM, ROM, a fixed hard drive, and so on) as well as removable media (e.g., Flash memory, a removable hard drive, an optical disc, and so forth). The computer-readable media 706 may be configured in a variety of other ways as further described below.

Input/output interface(s) 708 are representative of functionality to allow a user to enter commands and information to computing device 702, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 702 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 702. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 702, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 710 and computer-readable media 706 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 710. The computing device 702 may be configured to implement particular instructions and/or functions corresponding to the software and/or hardware modules. Accordingly, implementation of a module that is executable by the computing device 702 as software may be achieved at least partially in hardware, e.g., through use of computer-readable storage media and/or hardware elements 710 of the processing system 704. The instructions and/or functions may be executable/operable by one or more articles of manufacture (for example, one or more computing devices 702 and/or processing systems 704) to implement techniques, modules, and examples described herein.

The techniques described herein may be supported by various configurations of the computing device 702 and are not limited to the specific examples of the techniques described herein. This functionality may also be implemented all or in part through use of a distributed system, such as over a "cloud" 714 via a platform 716 as described below.

The cloud 714 includes and/or is representative of a platform 716 for resources 718. The platform 716 abstracts underlying functionality of hardware (e.g., servers) and software resources of the cloud 714. The resources 718 may include applications and/or data that can be utilized while computer processing is executed on servers that are remote from the computing device 702. Resources 718 can also include services provided over the Internet and/or through a subscriber network, such as a cellular or Wi-Fi network.

The platform 716 may abstract resources and functions to connect the computing device 702 with other computing devices. The platform 716 may also serve to abstract scaling of resources to provide a corresponding level of scale to encountered demand for the resources 718 that are implemented via the platform 716. Accordingly, in an interconnected device embodiment, implementation of functionality described herein may be distributed throughout the system 700. For example, the functionality may be implemented in part on the computing device 702 as well as via the platform 716 that abstracts the functionality of the cloud 714.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A method implemented by a computing device, the method comprising:

displaying, by the computing device, a representation of reference sound data concurrently with a representation of overdub sound data in a user interface;

receiving, by the computing device, inputs via the user interface as indicating corresponding alignment points between the representation of the reference sound data and the representation of the overdub sound data, the receiving the inputs including receiving at least some inputs of the inputs in succession as alternating between the representation of the reference sound data and the representation of the overdub sound data as indicating the corresponding alignment points;

determining, by the computing device, a time interval of the reference sound data that corresponds to a time interval of the overdub sound data based on the inputs;

applying, by the computing device, a stretch value to align an amount of time of the time interval of the overdub sound data with an amount of time of the time interval of the reference sound data; and generating, by the computing device, aligned sound data by replacing the time interval of the reference sound data within the reference sound data with the time interval of the overdub sound data having the stretch value based on the applying.

2. The method as described in claim 1, wherein the receiving of the inputs includes receiving additional inputs of the inputs that are different from the at least some inputs as a series of selections made through interacting with the representation of the reference sound data and then a series of selections made through interacting with the representation of the overdub sound data.

3. The method as described in claim 1, wherein the receiving of the inputs includes receiving the inputs as a series of selections by detecting gestures via the user interface.

4. The method as described in claim 1, wherein the reference sound data is in an different language than a language of the overdub sound data.

5. The method as described in claim 1, wherein the reference sound data has as lower quality than a quality used for the overdub sound data.

6. The method as described in claim 1, wherein the reference sound data and the overdub sound data both correspond to a photo shoot.

7. The method as described in claim 6, wherein the reference sound data has greater amount of noise than the overdub sound data.

8. The method as described in claim 1, wherein the displaying, the receiving, the determining, and the applying are performed for a plurality of said time intervals of the reference sound data and the overdub sound data and the generating further comprises dividing the generating of the aligned sound data for the plurality of said time intervals into interval alignment tasks that are processed in parallel.

9. A method implemented by a computing device, the method comprising:

displaying, by the computing device, a representation of reference sound data concurrently with a representation of overdub sound data in a user interface;

receiving, by the computing device, inputs via the user interface as indicating corresponding alignment points between the representation of the reference sound data and the representation of the overdub sound data, the receiving the inputs including receiving at least some inputs of the inputs in succession as alternating between the representation of the reference sound data and the representation of the overdub sound data as indicating the corresponding alignment points;

determining, by the computing device, a plurality of time intervals of the reference sound data that correspond to a plurality of time intervals of the overdub sound data based on the inputs;

dividing, by the computing device, the plurality of time intervals of the reference sound data and corresponding plurality of time intervals of the overdub sound data into a plurality of interval alignment tasks; and generating, by the computing device, aligned sound data by combining a result of parallel processing of the plurality of interval alignment tasks.

10. The method as described in claim 9, wherein the receiving of the inputs includes receiving additional inputs of the inputs that are different from the at least some inputs as a series of selections made through interacting with the representation of the reference sound data and then a series of selections made through interacting with the representation of the overdub sound data.

11. The method as described in claim 9, wherein the receiving of the inputs includes receiving additional inputs of the inputs that are different from the at least some inputs as a series of selections made through interacting with the representation of the overdub sound data and then a series of selections made through interacting with the representation of the reference sound data.

12. The method as described in claim 9, wherein the reference sound data is in an different language than a language of the overdub sound data.

13. The method as described in claim 9, wherein the reference sound data has as lower quality than a quality of the overdub sound data.

14. The method as described in claim 9, wherein the reference sound data has greater amount of noise than the overdub sound data.

15. A system comprising:

means for receiving inputs via a user interface as indicating corresponding alignment points between a representation of reference sound data in a user interface and a representation of overdub sound data, the receiving means including means for receiving at least some inputs of the inputs in succession as alternating between the representation of the reference sound data and the representation of the overdub sound data as indicating the corresponding alignment points;

means for determining a plurality of time intervals of the reference sound data that correspond to a plurality time intervals of the overdub sound data based on the inputs;

means for applying a stretch value to align amounts of time of the plurality of time intervals of the overdub sound data with amounts of time of corresponding ones of the plurality of time intervals of the reference sound data;

means for dividing the plurality of time intervals of the reference sound data and corresponding plurality of time intervals of the overdub sound data into a plurality of interval alignment tasks; and means for generating aligned sound data by combining a result of parallel processing of the plurality of interval alignment tasks, the generating means including means for replacing at least one said time interval of the reference sound data within the reference sound data with at least one said time interval of the overdub sound data having a respective said stretch value.

16. The system as described in claim 15, wherein the receiving means includes means for receiving additional inputs of the inputs that are different from the at least some inputs as a series of selections made through interacting with the representation of the reference sound data and then a series of selections made through interacting with the representation of the overdub sound data.

17. The system as described in claim 15, wherein the receiving means includes means for receiving additional inputs of the inputs that are different from the at least some inputs as a series of selections made through interacting with the representation of the overdub sound data and then a series of selections made through interacting with the representation of the reference sound data.

18. The method as described in claim 1, further comprising displaying, by the computing device, the corresponding alignment points in the user interface with unique display characteristics that indicate correspondence of the corresponding alignment points.

19. The method as described in claim 9, further comprising receiving, by the computing device, user inputs indicating correspondences between the plurality of time intervals of the reference sound data and the plurality of time intervals of the overdub sound data, wherein the determining the plurality of time intervals of the reference sound data that correspond to the plurality of time intervals of the overdub sound data is further based on the user inputs.

20. The system as described in claim 15, wherein the means for replacing the at least one said time interval of the reference sound data with the at least one said time interval of the overdub sound data includes means for removing noise from a video shoot that includes the at least one said time interval of the reference sound data.

* * * * *